United States Patent [19]

Blase

[11] Patent Number: 4,998,368

[45] **Date of Patent: * Mar. 12, 1991**

[54] FIREARM CLEANING DEVICE AND METHOD

[76] Inventor: Richard A. Blase, Rte. 2, Box 103, Asheboro, N.C. 27203

[ * ] Notice: The portion of the term of this patent subsequent to Jul. 4, 2006 has been disclaimed.

[21] Appl. No.: 377,060

[22] Filed: Jul. 10, 1989

[51] Int. Cl.[5] ..... F41A 29/00; F41A 29/04

[52] U.S. Cl. ..... 42/95; 102/442; 124/57

[58] Field of Search ..... 42/95, 1.14; 102/430, 102/440, 442, 529; 124/57, 74

[56] References Cited

U.S. PATENT DOCUMENTS

| | | | |
|---|---|---|---|
| 938,856 | 11/1909 | Fessenden | 102/529 |
| 1,495,008 | 5/1924 | Feagin | 102/529 |
| 2,375,314 | 5/1945 | Mills | 124/57 |
| 2,861,560 | 11/1958 | Alinari | 124/57 |
| 3,127,885 | 4/1964 | Kline et al. | 124/57 |
| 3,177,863 | 4/1965 | Spack | 124/57 |
| 3,494,344 | 2/1970 | Vadas et al. | 124/57 |
| 3,740,883 | 6/1973 | Kyle | 42/95 |
| 4,328,632 | 5/1982 | Beers | 42/95 |
| 4,697,523 | 10/1987 | Saxby | 102/440 |
| 4,783,925 | 11/1988 | Pollock, Jr. | 42/90 |
| 4,843,750 | 7/1989 | Blase | 42/95 |

FOREIGN PATENT DOCUMENTS

| | | | |
|---|---|---|---|
| 2599827 | 12/1987 | France | 102/529 |

*Primary Examiner*—Michael J. Carone
*Attorney, Agent, or Firm*—Wigman & Cohen

[57] ABSTRACT

A disposable firearm cleaning device and method are disclosed for cleaning the chamber and bore of a firearm, especially in the field. The cleaning device comprises a compressed gas cartridge which is supported in the chamber of the firearm in spaced relation to the walls thereof. A spring-loaded valve actuable by the firing pin of the firearm is adapted to release the compressed gas which flows between the cartridge and chamber walls and out the bore of the firearm to clean the chamber and bore. A second valve mounted to the cartridge allows the cartridge to be recharged with gas.

13 Claims, 3 Drawing Sheets

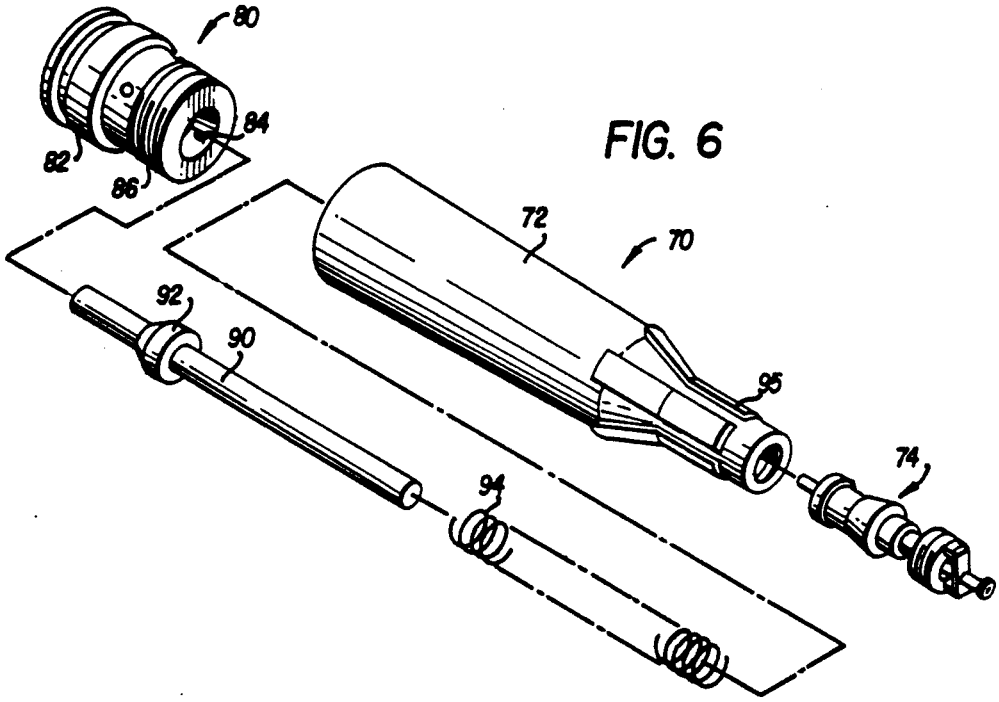
FIG. 6
FIG. 7
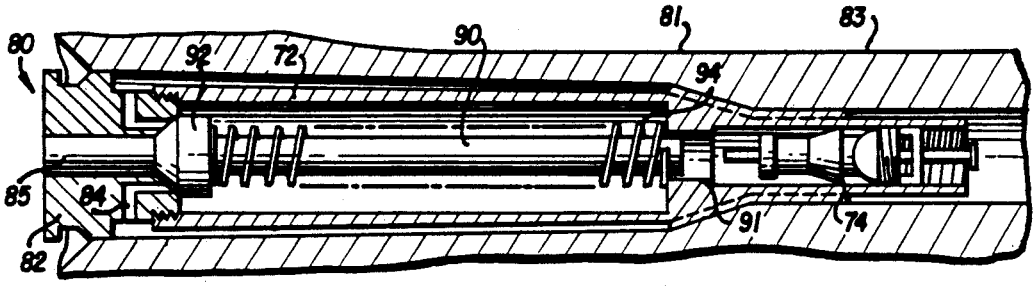
FIG. 8
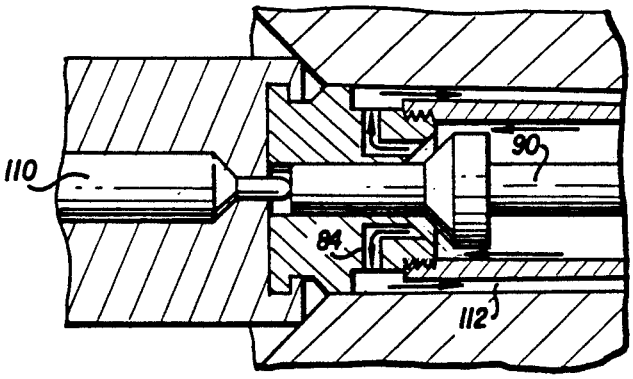

FIREARM CLEANING DEVICE AND METHOD

BACKGROUND OF THE INVENTION

The present invention relates to new and useful improvements to devices and methods for cleaning debris and dirt from firearms, such as rifles, shotguns, or the like, and, more particularly, to disposable and reusable firearm cleaning devices and methods which are convenient and specially adapted for use in the field.

Deposits of dirt, moisture, metal, burnt powder and similar foreign matter and debris on the interior side walls of the shell chamber and barrel or bore of a firearm is a common phenomenon. If uncorrected, such deposits not only cause the inside surfaces of the firearm to become scratched and corroded, but also can create a dangerous condition, particularly if the barrel becomes blocked by debris.

The bore of a firearm is conventionally cleaned by means of an elongated metal rod which includes cleaning implements, such as a brush or abrasive packs on one end. This technique is essential to proper maintenance of a firearm, but has been found to be bulky, tedious and inconvenient to use in the field.

Various attempts to obviate the aforementioned convenience problem have been described in the prior art. For example, U.S. Pat. No. 4,328,632 discloses a gun cleaning device which is of similar size and appearance to a standard shell and thus convenient to carry and use in the field. A compressed gas cartridge, upon discharge, is propelled through the gun barrel pushing a cleaning wad through the same. One disadvantage of this prior art device is the fact that the shell chamber, where the device is seated prior to activation, is not cleaned in the process. A further disadvantage of this device is that, upon activation, the compressed gas cartridge is rapidly discharged from the barrel opening in a manner similar to a projectile with the potential for causing injury and/or property damage.

In U.S. Pat. No. 938,836, there is similarly disclosed a gun cleaning device comprising a shell-like compressed gas cylinder which is punctured and drives out a "cleaning bullet" for cleaning the bore as it passes therethrough. However, this device also fails to clean the shell chamber portion of the firearm.

SUMMARY AND OBJECTS OF THE INVENTION

In view of the foregoing limitations and shortcomings of the prior art devices, it should be apparent that there still exists a need in the art for a convenient, field usable and disposable or reusable cleaning device capable of simultaneously flushing both the shell chamber and the firearm bore or barrel with compressed gas and which will not project a solid, bullet-like projectile capable of causing serious human injury or property damage.

It is, therefore, a primary object of this invention to fulfill that need by providing a disposable or reusable firearm cleaning device having configurations similar to those of standard shells and, hence, is convenient to use and carry and which effectively and safely cleans both the shell chamber and the barrel or bore walls of a firearm.

More particularly, it is an object of this invention to provide a firearm shell chamber and bore cleaner, especially for use in the field, comprising a cartridge containing a compressed gas, such as $CO_2$ or the like, which upon discharge will effectively flush deposits of dirt, moisture, metal, burnt powder and the like and which may, at the option of the user, propel an attachable lightweight lubricated cleaning wad through the firearm barrel to further loosen and remove such deposits and to apply a lubricant to the inside wall of the barrel.

It is another object of this invention to provide a firearm cleaner of the aforesaid type wherein the cartridge may be easily recharged by the user.

Yet another object of the invention is to provide a device of the aforesaid type wherein a self-contained, spring-biased valve in the device is capable of activating the device by allowing the discharge of the compressed gas.

A further object of the invention is to provide a device of the aforesaid type wherein the cartridge is formed to fit securely in the barrel of the gun.

A further object of the invention is to provide a safe, convenient and economical method of cleaning a firearm in the field using the device of the aforesaid type.

These and other objects and advantages of the present invention will become apparent by reference to the more detailed description which follows, as well as to the appended claims and the several views illustrated in the drawings.

BRIEF DESCRIPTION OF THE DRAWINGS

FIG. 6 is an exploded view of an alternative embodiment of the firearm cleaning device of the present invention.

FIG. 7 is an enlarged side view, partly in section, of the firearm cleaning device of FIG. 6 shown situated within the chamber of a firearm; and FIG. 8 is an enlarged side view of the invention showing activation of the compressed gas release mechanism.

DETAILED DESCRIPTION OF A PREFERRED EMBODIMENT

Figure 1:
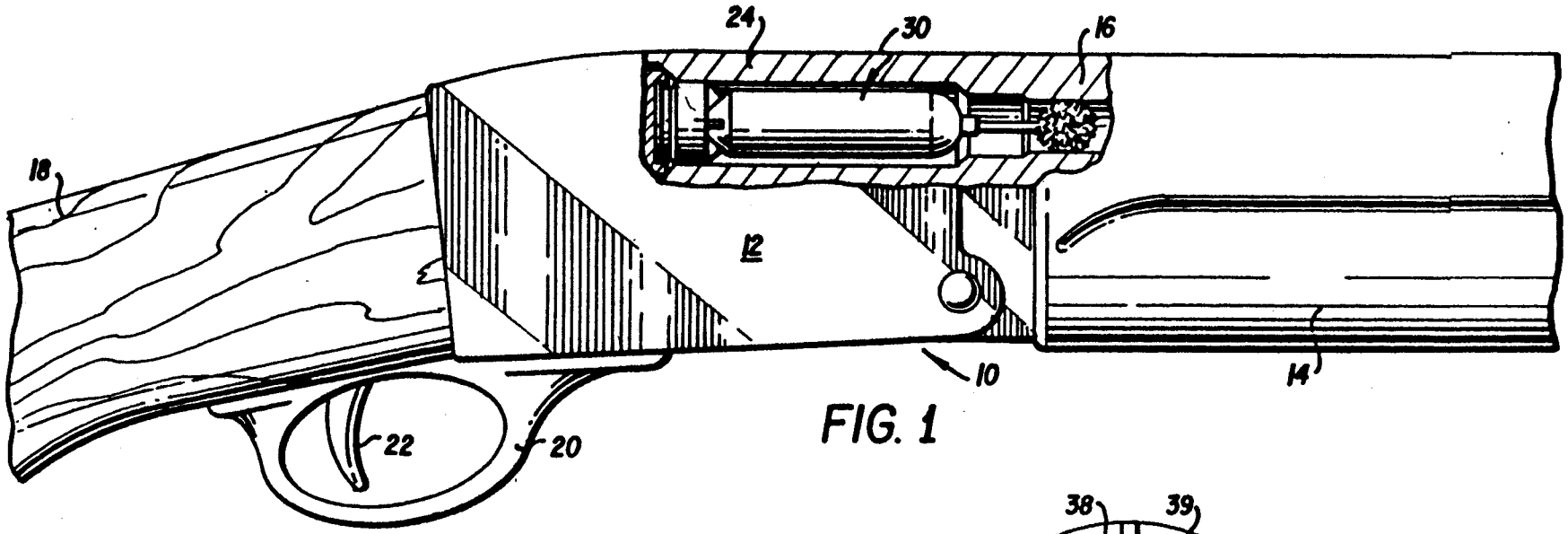
FIG. 1 is a fragmentary cross-sectional view of a firearm showing one embodiment of a firearm cleaning device of the present invention situated therein.
Figure 5:
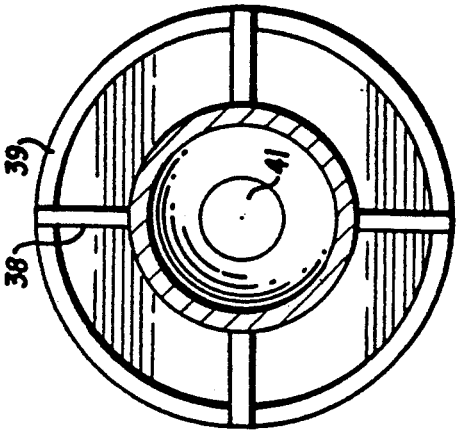
FIG. 5 is a cross-section view taken along line 5-5 of FIG. 3.
Figure 4:
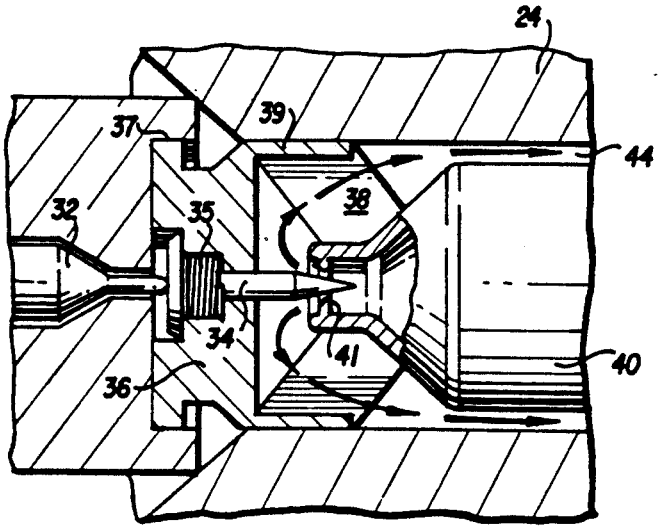
FIG. 4 is an enlarged view of the firing mechanism showing the puncturing of the gas cartridge.

Referring more particularly to the drawings wherein like numerals indicate like elements throughout the several views, there is illustrated in FIG. 1 a first embodiment of the cleaning device of the present invention used in connection with a firearm designated generally by reference numeral 10. In particular, the firearm 10, a shotgun for example, includes a receiver 12, fore-end 14, barrel 16 and stock 18. Also included in such conventionally firearm is a trigger guard 20, and trigger 22 conventionally connected by a mechanism (not shown) to a firing pin 32 (FIG. 4) which is driven forwardly in the receiver 12 through an opening in the rearward end of chamber 24.

Figure 3:
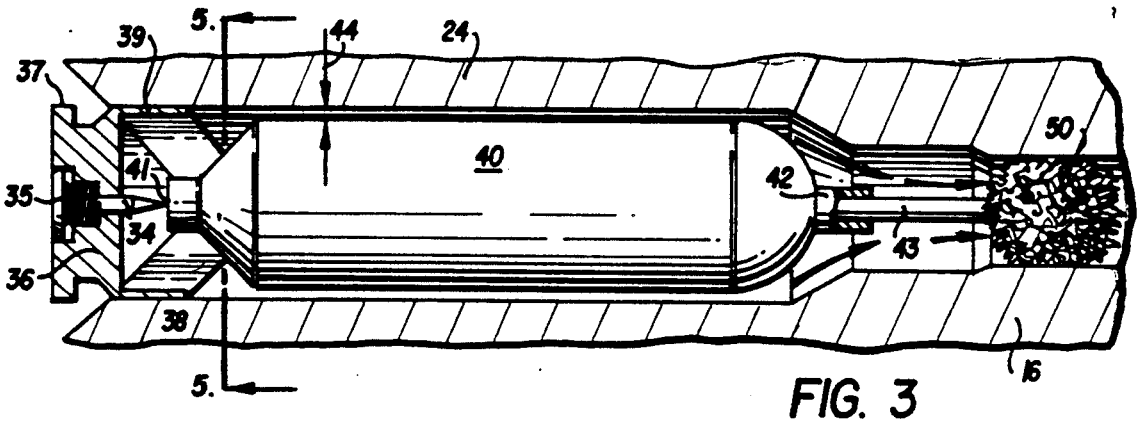
FIG. 3 is a side view partly in section of the cleaning device of FIG. 1 in a pre-actuation position.

The firearm cleaning device 30 may be used for a variety of different types of firearms, including shotguns, rifles, pistols and revolvers. As best seen in FIG. 3, the present firearm cleaning device 30, comprises a compressed gas cartridge 40 which is sealed on its rearward end by a rupturable disc 41. Sleeve means 42 is centrally mounted (as by welding) on the forward end of the cartridge 40 adjacent the rearward or chamber end of barrel 16. Sleeve means 42 receives a barrel swab comprising a stem 43 on which is mounted a cleaning wad 50. At the rearward end of the cartridge 40 positioned adjacent to the firing pin 32 (FIG. 4) is a structure 36 supporting a spring-biased pin 34 adapted to puncture the disc 41 in response to activation by forward movement of the firing pin 32. The cartridge 40 is centrally positioned within the chamber in spaced relation to the chamber sidewalls by a plurality of fins or struts 38 which are secured to a ring 39 and flange 37 which forms a part of the structure 36. The diameter of cartridge 40 is preferably greater than the diameter of the barrel 16, but less than the diameter of the chamber 24 resulting in annular space 44 through which the discharging gas can escape upon rupture of disc 41.

In the use and operation of the present firearm cleaning device, which is similar in size and shape to an unfired shell, the device 30 is inserted in the chamber with a freshly lubricated barrel swab. The chamber is then closed so that the device 30 is situated in the position illustrated in FIG. 1. The firearm is pointed in a safe direction, and the firing pin is actuated by a hammer in receiver 12 when trigger 22 is pulled. The firing pin 32 strikes the spring-biased pin 34 which, in turn, strikes and ruptures disc 41 and is retracted from the disc by the spring 35 thereby releasing the $CO_2$, or other suitable gas, such as nitrogen, air, etc. from the cylinder 40. The escaping gas is deflected by structure 36 and rapidly flows forwardly to the annular space 44 formed between the compressed gas cylinder 40 and the chamber walls (as shown by the arrows in FIG. 4) thereby removing debris from the chamber walls. The escaping gas continues to flow forwardly to the barrel 16 (as shown by the arrows in FIG. 3) removing debris and propels the barrel swab and its cleaning wad 50 through the barrel 16. As wad 50 travels through the barrel, it wipes the inner surface of the barrel 16 to loosen any residual dirt, burnt powder, moisture or other debris which is then carried through the bore 16 and out the free end of the barrel.

Alternatively, at the discretion of the user, the device may be used without the barrel swab and its cleaning wad 50 if, for example, the bore is blocked or if the quantity of dirt and debris in the bore 16 is such that it may impede safe or effective passage of wad 50 through the bore 16. A lubricant may also be incorporated in the compressed gas in a conventional manner, especially for use without a barrel swab.

As the $CO_2$ is discharged, the device 30 including the cartridge 40 is retained in place in the chamber 24 in the same manner as a live shell would be retained, that is, by a conventional mechanism (not shown) which grips the flange 37. Even if the device were not gripped in such a fashion, the relative diameters of the cartridge 40 and barrel 16 would prevent the cartridge from being projected through the barrel. Following activation, the spent cartridge and discharged barrel swab and cleaning wad 50, all composed of inexpensive materials, may be disposed of in a conventional manner.

An alternative embodiment of the present invention illustrated in FIG. 6 through 8, is designated generally by reference numeral 70. Device 70 comprises a compressed gas cartridge 72 which is sealed on its forward end by a spring-loaded refill valve 74 and at its rearward end by a spring-loaded discharge valve assembly designated generally by reference numeral 80.

The discharge valve assembly 80 is comprised of a nozzle portion 82 provided with a plurality of outlets 84 through which the compressed gas is discharged. Nozzle portion 82 is provided with threads 86 which cooperate with threading on cartridge 72 allowing the nozzle to be removably mounted to the cartridge.

A valve stem 90 is positioned inside the cartridge and is slidably mounted at one end within annular ring 91 and at its opposite end within aperature 85 of nozzle 82. A head 92 is mounted to valve stem 90 and is formed to engage nozzle 82 (FIG. 8). A spring 94 is disposed between annular ring 91 and head 92 such that the valve stem 90 and head 92 are biased in the direction of the nozzle thereby preventing the escape of gas through the outlets until it is to be discharged.

As best viewed in FIG. 6, cartridge 72 is tapered at its forward end to extend into the barrel 83 of the firearm. A plurality of channels 95 are provided along the tapered portion of cartridge 72 to allow the escaping gas to flow from shell chamber 81 to barrel 83.

In the use and operation of the present firearm cleaning device, which is similar in size and shape to an unfired shell, the device 70 is inserted in the chamber. The chamber is then closed so that the device 70 is situated in the position illustrated in FIG. 7. The firearm is pointed in a safe direction, and the firing pin 110 is actuated when the trigger is pulled. The firing pin 110 strikes the spring-biased stem 90 moving the head 92 away from the outlets 84 thereby releasing the pressurized $CO_2$ or other suitable gas, such as nitrogen, air, etc. from the cylinder 72. The escaping gas rapidly flows forwardly to the annular space 112 formed between the compressed gas cylinder 72 and the chamber walls (as shown by the arrows in FIG. 8) thereby removing debris from the chamber walls. The escaping gas continues to flow forwardly to the barrel 83 (as shown by the arrows in FIG. 7) removing debris.

Figure 2:
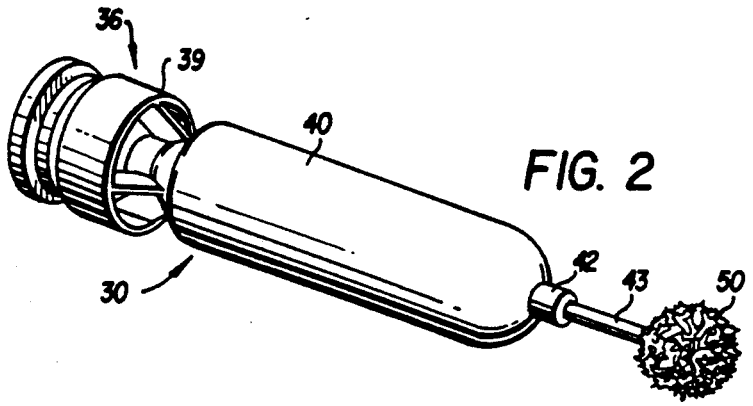
FIG. 2 is a perspective view of the firearm cleaning device shown in FIG. 1.

At the discretion of the user, the device may be used with a swab and cleaning wad similar to that shown in FIG. 2 which can be inserted adjacent the recharge valve 74.

As the $CO_2$ is discharged, the device 70 including the cartridge 7 is retained in place in the chamber 81 in the same manner as a live shell would be retained, that is, by a conventional mechanism (not shown) which grips the nozzle 82. Even if the device were not gripped in such a fashion, the relative diameters of the cartridge 72 and barrel 83 would prevent the cartridge from being projected through the barrel. Following activation, the spent cartridge may be recharged through refill valve 74 in a conventional manner such as an air compressor or pressurized canister.

From the foregoing description, it will be apparent that the present invention provides an extremely simple and economical device for cleaning both the chamber and barrel walls of a firearm while in the field. The present invention also is safer to use than the known prior art cleaning devices described above because cleaning is accomplished without projecting a hard or otherwise dangerous object which can injure the user or persons standing nearby or damage property.

It will be appreciated that many modifications and variations of the present invention are possible in light of the above teachings and within the purview of the appended claims without departing from the spirit and intended scope of the invention.

What I claim is:

1. A device for cleaning the bore of a firearm having a firing pin and a shell chamber, said device comprising a compressed gas cartridge of a size sufficient to be received in said chamber of said firearm, said cartridge having a first end adapted to be positioned toward the bore of the firearm and a second end adapted to be positioned toward the firing pin of the firearm, means for discharging compressed gas only from the second end of the cartridge to flush both the shell chamber and bore of said firearm with the discharged gases from said cartridge and means for recharging said cartridge with compressed gas following said discharge.

2. The device according to claim 1, wherein said compressed gas cartridge is a cylinder having a smaller diameter than the diameter of said chamber forming an annular space of a magnitude sufficient to accommodate passage of said gas upon discharge.

3. The device according to claim 1, wherein said means for recharging said cartridge includes a spring-loaded valve disposed at the first end of said cartridge.

4. The device according to claim 3, wherein said valve is removably mounted to said cylinder.

5. The device according to claim 1, including a cleaning wad mounted on the first end of said cartridge.

6. The device of claim 1, including swab means releasably mounted to said cartridge at the first end thereof adjacent the bore for cleaning the bore.

7. The device of claim 6, wherein said swab means comprises a stem and a wad mounted on said stem.

8. A method of cleaning the bore of a firearm having a trigger mechanism, a firing pin, a shell chamber with walls and a barrel with walls comprising the steps of:

providing a compressed gas cylinder having a first end and a second end;

positioning said cylinder in the shell chamber with the first end disposed toward the bore and the second end disposed toward the firing pin;

discharging the gas only from the second end of said cylinder;

removing unwanted debris from the walls of the shell chamber and barrel of said firearm by means of the flow of the said discharged gas; and recharging said cylinder with gas.

9. A device for cleaning the bore of a firearm having a firing pin and a shell chamber, said device comprising a compressed gas cartridge tapered and sized so as to be received simultaneously in both said shell chamber and said bore of said firearm whereby the discharged gases from said cartridge flush both the shell chamber and bore of said firearm, said cartridge including means for recharging said cartridge with compressed gas following said discharge.

10. The device of claim 9, wherein said cartridge has first and second ends, the first end being disposed toward the bore of the firearm and the second end being disposed toward the firing pin, the compressed gas being discharged from the second end of the cartridge, said recharging means being disposed in the first end of the cartridge.

11. The device of claim 10, including a spring-loaded valve means in said cartridge for discharging the compressed gas in the cartridge from the second end thereof.

12. The device of claim 10, wherein said recharging means comprises a spring-loaded refill valve.

13. The device of claim 11, wherein said valve means comprises a valve stem with a valve head seated in the second end of the cartridge, spring means disposed about said valve stem for urging said valve head toward its seated position and outlet means in said second end through which the gas is discharged.

* * * * *